United States Patent [19]

Miyoshi

[11] Patent Number: 4,702,587

[45] Date of Patent: Oct. 27, 1987

[54] SHELL-TYPE ELECTROSTATIC COPYING APPARATUS

[75] Inventor: Yoshitake Miyoshi, Ikoma, Japan

[73] Assignee: Mita Industrial Co., Ltd., Osaka, Japan

[21] Appl. No.: 832,542

[22] Filed: Feb. 24, 1986

[30] Foreign Application Priority Data

Feb. 27, 1985 [JP] Japan ..... 60-36655

[51] Int. Cl.[4] ..... G03G 15/04

[52] U.S. Cl. ..... 355/3 R; 355/3 DR

[58] Field of Search ..... 355/3 R, 3 DR, 3 SH, 355/8

[56] References Cited

U.S. PATENT DOCUMENTS

| | | | |
|---|---|---|---|
| 3,861,306 | 1/1975 | DuBois et al. | 355/3 R X |
| 4,124,289 | 11/1978 | Miyata et al. | 355/8 X |
| 4,386,841 | 7/1983 | Wakao et al. | 355/3 DR |
| 4,563,077 | 1/1986 | Komada | 355/3 R X |
| 4,585,324 | 4/1986 | Koyama et al. | 355/3 DR X |

*Primary Examiner*—Arthur T. Grimley
*Assistant Examiner*—J. Pendegrass
*Attorney, Agent, or Firm*—Beveridge, DeGrandi & Weilacher

[57] ABSTRACT

A shell-type electrostatic copying apparatus comprising a supporting structure consisting of a lower supporting frame and an upper supporting frame mounted on the lower supporting frame for free pivoting between an open position and a closed position about a first pivot axis as a center, an endless carrier member having a photosensitive material disposed on its peripheral surface, a developing device for developing a latent electrostatic image formed on the surface of the photosensitive material and a copying paper conveying mechanism. A supporting unit frame is mounted on the lower supporting frame about a second pivot axis, and the endless carrier member and the developing device are disposed on the supporting unit frame, when the upper supporting frame is caused to pivot about the first pivot axis in the state where the supporting unit frame and the upper supporting frame are connected, the supporting unit frame is caused to pivot about the second pivot axis following the pivoting movement of the upper supporting frame.

10 Claims, 8 Drawing Figures

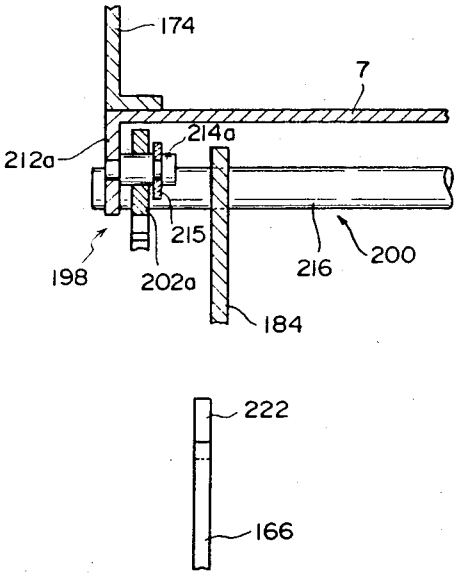
FIG. 5-C
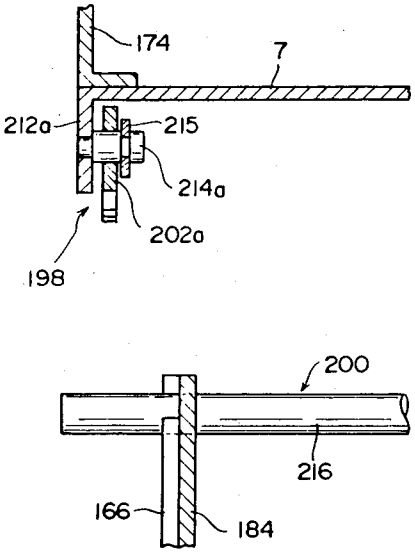
FIG. 5-B
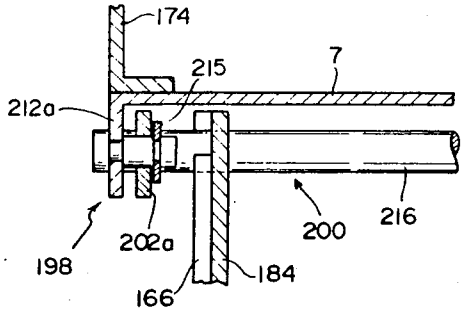
FIG. 5-A

SHELL-TYPE ELECTROSTATIC COPYING APPARATUS

BACKGROUND OF THE INVENTION

1. Field of the Invention

This invention relates to an electrostatic copying apparatus, particularly one called a shell type.

2. Description of the Prior Art

It is known to those skilled in the art that electrostatic copying apparatuses of the shell type comprising an upper supporting frame and a lower supporting frame connected to each other for free relative pivoting movement between an open position and a closed position (usually the lower supporting frame is disposed at a predetermined position and the upper supporting frame is mounted on the lower supporting frame so as to pivot freely between the open position and the closed position) have been proposed and come into commercial acceptance. Such a shell-type electrostatic copying apparatus has the general advantage that when the upper supporting frame is caused to pivot to the open position, most of a copying paper conveying passage in which a copied image is formed is open, and therefore, in the event of paper jamming in the paper conveying passage, the paper can be easily removed out of the passage.

In this type of conventional electrostatic copying apparatus, importance is attached to the removing of paper that has jammed up particularly in a transfer zone and a fixing device. For this reason, a rotating drum, a developing device, etc. are mounted on the upper supporting frame and the lower supporting frame and the upper supporting frame are connected so that they can pivot freely about a fulcrum in the paper supply side of the apparatus. Consequently, in ralation to these arrangements, the apparatus has various inconveniences. Specifically, the paper conveying passage cannot be fully opened at its upstream side portion and in the event of paper jamming at this part, the paper cannot be easily taken out. Especially where a plurality of paper cassettes are disposed vertically on the upstream side of the paper conveying passage, the removal of paper that has jammed up is difficult. Because the developing device moves as a unit with the upper supporting frame, toner particles are supplied by inserting a toner cartridge from the front side of the copying apparatus and mounting it detachably. Because of this, the feeding of the toner particles is likely to become non-uniform in the front-back direction of the developing device, and also it is impossible to determine clearly the amount of the toner particles that remain. In addition, since the rotating drum also moves as a unit with the upper supporting frame, the cleaned surface of a photosensitive material disposed on the peripheral surface of the rotating drum cannot be easily observed visually, and it is difficult to confirm the cleaning action of the apparatus.

SUMMARY OF THE INVENTION

It is a primary object of this invention to provide an improved shell-type electrostatic copying apparatus which can eliminate the aforesaid inconveniences of a conventional shell-type electrostatic copying apparatus without impairing its advantages.

Other objects of this invention will becomes apparent from the following description.

According to this invention, there is provided a shell-type electrostatic copying apparatus comprising a supporting structure consisting of a lower supporting frame and an upper supporting frame mounted on the lower supporting frame for free pivoting between an open position and a closed position about a first pivot axis as a center, and endless carrier member having a photosensitive material disposed on at least part of its peripheral surface, a developing device for developing a latent electrostatic image formed on the surface of the photosensitive material on the endless supporting member, and a copying paper conveying mechanism for conducting a copying paper sheet from one end of the supporting structure to the other: wherein the first pivot axis exists at said other end of the supporting structure, a supporting unit frame is mounted on the lower supporting frame so that it pivots freely about a second pivot axis extending substantially parallel to the first pivot axis, and the endless carrier member and the developing device are disposed on the supporting unit frame, a connecting means is provided for connecting the supporting unit frame to the upper supporting frame, and when the supporting unit frame is connected to the upper supporting frame and the upper supporting frame is caused to pivot about the first pivot axis, the supporting unit frame pivots about the second pivot axis following the pivoting movement of the upper supporting frame.

BRIEF DESCRIPTION OF THE DRAWINGS

FIGS. 5-A to 5-C are partial sectional views respectively showing that the upper supporting frame is held at a closed position; the upper supporting frame is kept slightly open when the connection between the upper supporting frame and the supporting unit frame is cancelled; and the upper supporting frame is kept slightly open when it is connected to the supporting unit frame;

DETAILED DESCRIPTION OF PREFERRED EMBODIMENTS

Figure 1:
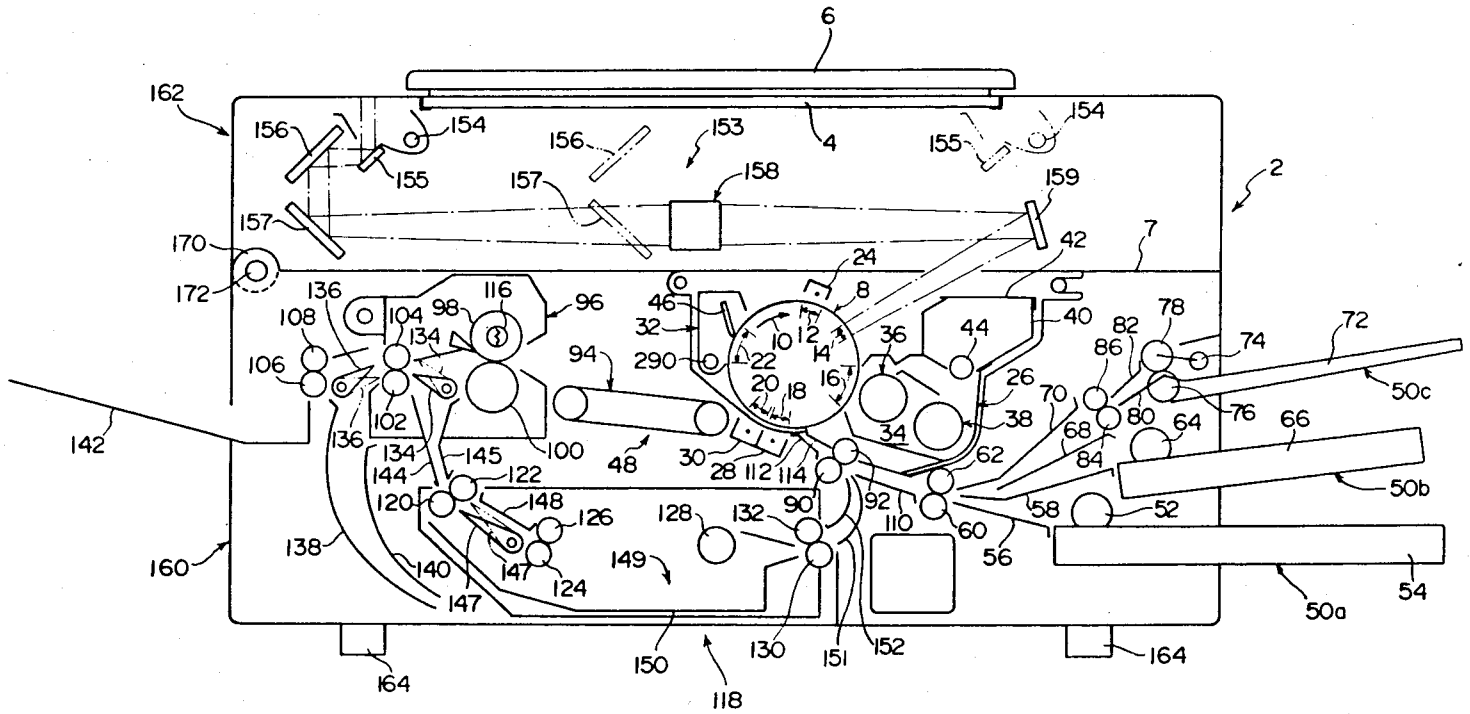
FIG. 1 is a simplified sectional view showing one embodiment of the electrostatic copying apparatus constructed in accordance with this invention in a simplified form.

One specific embodiment of the shell-type electrostatic copying apparatus constructed in accordance with this invention will be described in detail with reference to the accompanying drawings.

First, with reference to FIG. 1, the general structure of the shell-type electrostatic copying apparatus shown will be described at some length.

The illustrated electrostatic copying apparatus has a housing shown generally at 2. On the upper surface of the housing 2 is disposed a transparent plate 4 on which a document to be copied is placed. Also attached to the upper surface of the housing 2 is an openable and closable document holder 6 for covering the transparent plate 4 and the document placed on it (in FIG. 1, the document holder 6 is shown in its closed position at which it covers the transparent plate 4).

The housing 2 is divided into an upper space and a lower space by a horizontal plate 7, and an endless carrier member defining an endless moving passage is disposed in the upper portion of the nearly central part of the lower space. In the specific embodiment illustrated, the endless carrier member is constructed of a rotating drum 8 composed of a cylindrical support and a photosensitive material disposed on at least a part of the peripheral surface (on the entire peripheral surface in the specific embodiment) of the rotating drum. Instead of the rotating drum 8, the endless carrier member may be formed of an endless belt known per se. Around the rotating drum 8 to be rotated in the direction of an arrow 10 are disposed a charging zone 12, an exposing zone 14, a developing zone 16, a transfer zone 18, a peeling zone 20 and a cleaning zone 22 in the order stated as viewed in the rotating direction of the drum 8. A charging corona discharger 24 is provided in the charging zone 12; a developing device 26, in the developing zone 16; a transfer corona discharger 28, in the transfer zone 18; a peeling corona discharger 30, in the peeling zone 20; and a cleaning device 32, in the cleaning zone. The illustrated developing device 26 has a development receptacle 34 for holding a developer composed of toner particles and carrier particles, and a magnetic brush mechanism 36 adapted to be revolved in a predetermined direction is disposed at that site of the inside of the development receptacle 34 which faces the rotating drum 8. An agitating mechanism 38 for agitating the developer is also disposed within the development receptacle 34. An opening is formed at the upper surface of the development receptacle 34, and a toner particle receptacle 40 is mounted on the opening portion. The upper surface of the toner particle receptacle 40 is opened, and a an openable closure 42 is attached to the opening portion of the upper surface. A discharge opening is formed in the bottom wall of the toner particle receptacle 40, and a toner particle supply roller 44 is rotatably mounted on the discharge opening. Hence, fresh toner particles are supplied to the toner particle receptacle 40 by opening the closure 42. The toner particles held by the toner particle receptacle 40 are supplied to the development receptacle 34 through the discharge opening by the rotation of the toner particle supply roller 44. The developer within the development receptacle 34 is held by the magnetic brush mechanism 36 and brought into contact with the peripheral surface of the rotating drum 8 in the developing zone 16. The illustrated cleaning device has a cleaning blade 46 adapted to act on the surface of the photosensitive material on the rotating drum 8.

A copying paper conveying mechanism shown generally at 48 is disposed in the lower portion of the housing 2. A copying paper feeding means is provided at one end portion (the right end portion in FIG. 1) of the paper conveying mechanism 48. In the illustrated embodiment, the paper feeding means is comprised of a first copying paper feeding device **50*a* and a second copying paper feeding device 50*b* of the cassette feeding type and a third copying paper feeding device 50*c* of the table feeding type. The first paper feeding device 50*a* consists of a combination of a cassette-receiving section having a feed roller 52 provided therein and a copying paper cassette 54 detachably loaded into the cassette-receiving section through an opening formed in the right wall of the housing 2. Copying paper sheets are fed one by one from a stack of sheets (not shown) received in the paper cassette 54 by the action of the feed roller 52. A copying paper sheet which has been delivered from the cassette 54 passes between guide plates 56 and 58 and fed to a pair of conveying roller units 60 and 62**.

The second copying paper feeding device **50*b* disposed above the first paper feeding device 50*a* consists of a combination of a cassette-receiving section having a feed roller 64 provided therein and a copying paper cassette 66 to be loaded detachably into the cassette-receiving section through the opening formed in the right wall of the housing 2. Copying paper sheets (not shown) received in the paper cassette 66 are fed one by one by the action of the feed roller 64. A copying paper fed from the cassette 66 passes between a guide plate 58 and guide plates 68 and 70 and fed to the pair of conveying roller units 60 and 62**.

The third copying paper feed device **50*c* disposed above the second copying paper device 50*b* consists of a paper feed table 72 disposed at the opening formed in the right wall a feed roller 74 provided above the feed table 72 vertically movably and a pair of separating roller units 76 and 78. Copying paper sheets placed on the feed table 72 are fed one by one by the action of the pair of separating roller units 76 and 78. In the embodiment illustrated, the lower separating roller unit 76 is rotated in a direction opposite to the paper conveying direction, and the upper separating roller unit 78 is rotated in the same direction as the paper conveying direction in order to ensure the separation of the copying paper sheet. The copying paper sheet fed from the paper feed table 72 advances between guide plates 80 and 82 and is fed to a pair of conveying roller units 84 and 86, and then by the action of the conveying roller units 84 and 86, it is passed between the guide plates 68, 58 and the guide 70 and fed to the conveying roller units 60 and 62. In the above embodiment, copying paper sheets of JIS A3 size are accommodated in the paper cassette 54; and copying paper sheets of JIS A4 size, in the paper cassette 66. Copying paper sheets of a desired size are placed on the paper feed table 72**.

The illustrated paper conveying mechanisms includes the pair of conveying roller units 60 and 62, a pair of conveying roller units 90 and 92, a conveying belt mechanism 94, an upper roller 98 and a lower roller 100 of the fixing device 96, a pair of switch-over conveying roller units 102 and 104 and a pair of discharge rollers 106 and 108. Hence, the copying paper sheet fed to the pair of conveying roller units 60 and 62 from the paper feeding means (the first paper feeding device **50*a*, the second paper feeding device 50*b* or the third paper feeding device 50*c*) as stated above is then conveyed to the conveying roller units 90 and 92 over a guide plate 110 by the action of the conveying roller units 60 and 62, and is passed between guide plates 112 and 114 and conveyed to the transfer zone 18 and the peeling zone 20 by the action of the conveying roller units 90 and 92. Thereafter, the copying paper sheet is conveyed by the action of the conveying belt mechanism 94 and fed between the upper roller 98 having a heater 116 disposed therein and the lower roller kept in press contact with the upper roller 98**.

It will be seen from FIG. 1 that the illustrated electrostatic copying apparatus permits copying on both surfaces of the copying paper. In connection with this, a copying paper reversing-conveying mechanism 118 is provided below the paper conveying mechanism 48. The illustrated paper reversing-conveying mechanism 118 has a pair of conveying roller units 120 and 122, a pair of conveying roller units 124 and 126, a feed roller 128 and a pair of conveying roller units 130 and 132. The paper reversing-conveying mechanism 116 further includes a first conveying direction switch-over means disposed between the upper roller 98 and lower roller 100 and the pair of switch-over roller units 102 and 104, a second conveying direction switch-over means disposed between the pair of switch-over conveying roller units 102 and 104 and the pair of discharge rollers 106 and 108, and a holding portion for switching over the conveying direction disposed below the second conveying direction switch-over means. The first conveying direction switch-over means has a switch-over guide member 134 oscillable between a first position shown by a solid line in FIG. 1 and a second position shown by a one-dot chain line in FIG. 1. The switch-over guide member 134 is held at the first position when it conducts the copying paper from the upper roller 98 and the lower roller 100 towards the pair of switch-over conveying roller units 102 and 104, and at the second position when it conducts the copying paper from the holding member for switching over the conveying direction to the conveying roller units 120 and 122 of the paper reversing-conveying mechanism 118 by the action of the switch-over conveying roller units 102 and 104.

The second conveying direction switch-over means has a switch-over guide member 136 oscillable between a first position shown by a one-dot chain line in FIG. 1 and a second position shown by a solid line in FIG. 1. The switch-over guide member 136 is held at the first position when it conducts the copying paper from the switch-over conveying roller units 102 and 104 towards the discharge roller units 106 and 108, and at the second position when it conducts the copying paper from the upper roller 98 and the lower roller 100 to the holding portion for switching over the conveying direction by the action of the switch-over conveying roller units 102 and 104 or when it conducts the copying paper from the aforesaid holding portion towards the pair of conveying rollers units 120 and 122 of the paper reversing-conveying mechanism 118 by the action of the switch-over conveying roller units 102 and 104. The aforesaid positioning of the switch-over guide members 134 and 136 is achieved by an actuator such as an electromagnetic solenoid. The holding portion for switching over the conveying direction is comprised of a pair of guiding-holding plates 138 and 140, and having regard to the foregoing statement, the switch-over conveying roller units 102 and 104 are capable of rotating in the normal and reverse directions. Thus, in discharging the copying paper out of the housing 2, the switch-over guide members 134 and 136 are held at the first position in the paper reversing-conveying mechanism 118. As a result, the paper conveyed by the action of the upper roller 98 and the lower roller 100 of the fixing device 96 is fed to the pair of switch-over conveying rollers 102 and 104 via the upper surface of the switch-over guide member 134, conveyed to the discharge roller units 106 and 108 over the switch-over guide member 136 by the action of the switch-over conveying roller units 102 and 104 which are rotating in the normal direction (the direction in which the paper is conveyed downstream), and thereafter discharged into a receiving tray 142 through an opening formed in the left wall of the housing 2 by the action of the discharge roller units 106 and 108. On the other hand, when the copying paper is to be conducted to the upstream portion of the paper conveying mechanism 48, the switch-over guide member 134 is held at the aforesaid first position and the switch-over guide member 136, at the second position. The copying paper conveyed by the action of the upper roller 98 and the lower roller 100 of the fixing device 96 is fed to the switch-over conveying roller units 102 and 104 via the upper surface of the switch-over guide member 134, and conducted to the space between the guiding-holding members 138 and 140 by being guided by the lower surface of the switch-over guide member 136 under the action of the switch-over conveying roller units 102 and 104 rotating in the normal direction. When the trailing end of the paper conveyed as above goes past the switch-over guide member 134 (at which time the trailing end of the copying paper is nipped between the pair of switch-over conveying roller units 102 and 104), the switch-over guide member 134 is held at the second position and simultaneously the pair of switch-over conveying roller units 102 and 104 are rotated in the reverse direction (in the direction in which the copying paper is conveyed upstream). The copying paper conducted to the space between the guiding-holding plates 138 and 140 is guided from its trailing end side to the lower surface of the switch-over guide member 134 by the action of the switch-over conveying roller units rotating in the reverse direction, and further fed to the conveying roller units 120 and 122 via the space between a pair of guide members 144 and 145. Between the conveying roller units 120 and 122 and the conveying roller units 124 and 126 is provided an oscillating guide member 147 oscillable between a first position shown by a solid line and a second position shown by a one-dot chain line. The oscillating guide member 147 is held at the first position when the copying paper has a relatively small size, and at the second position when it has a relatively large size. When the copying paper has a relatively small size, the paper fed to the conveying roller units 120 and 122 is conveyed to the conveying roller units 124 and 126 via the space between the oscillating guide member 147 and a guide plate 148 by the action of the conveying roller units 120 and 122, and then conducted to an intermediate tray 150 of an intermediate stock portion 149 by the action of the conveying roller units 124 and 126. On the other hand, when the copying paper has a relatively large size, the copying paper fed to the conveying roller units 120 and 122 is conveyed by the action of these rollers, and conducted directly to the intermediate tray of the intermediate stock portion 149 by being guided by the under surface of the oscillating guide member 147. The copying paper temporarily stored in the intermediate stocl portion 149 is delivered from the stock portion 149 by the action of the feed roller 128, then fed to the upstream portion of the conveying mechanism 48 (in the illustrated embodiment, the upstream side of the convyeing roller units 90 and 92) via the space between guide plates 151 and 152 by the action of a pair of conveying roller units 130 and 132 to be described, and discharged out of the housing 2 by the action of the paper conveying mechanism 48.

In the upper space of the housing is disposed an optical system shown generally at 153 for exposing and scanning a document placed on the transparent plate 4 and projecting the image of the document onto the photosensitive material on the rotating drum 8 in the exposing zone 14. The optical system 153 includes a document illuminating lamp 154 for illuminating the document placed on the transparent plate 4, and a first reflecting mirror 155, a second reflecting mirror 156, a third reflecting mirror 157, a lens assembly 158 and a fourth reflecting mirror 159 for projecting the reflected light from the document onto the photosensitive material. At the time of scanning and exposure, the document illuminating lamp 154 and the first reflecting mirror 155 is moved at a given speed V from its start-of-scan position shown by a solid line to a given position (for example, an end-of-maximun scan position shown by a two-dot chain line) substantially horizontally, and the second reflecting mirror 156 and the third reflecting mirror 157 are moved at a speed half of the above given speed, V/2, from a start-of-scan position shown by a solid line to a given position for example, an end-of-maximum scanning position shown by a two-dot chain line. During this time, the reflected light from the document illuminated by the document illuminating lamp 154 is reflected successively by the first reflecting mirror 155, the second reflecting mirror 156 and the third reflecting mirror 157 and reaches the lens assembly 158. Thereafter, it is reflected by the 4th reflecting mirror 159, and reaches the surface of the photosensitive material in the exposing zone 14 through an opening formed in the horizontal plate 7. When scanning and exposure are over, the document illuminating lamp 154, the first reflecting mirror 155, the second reflecting mirror 156 and the third reflecting mirror 157 are returned to the start-of-scan position shown by the solid line.

In the electrostatic copying apparatus described above, while the rotating drum 8 is rotated in the direction of arrow 10, the charging corona discharger 24 substantially uniformly charges the photosensitive material to a specified polarity in the charging zone 12, and then the optical system 153 projects the image of the document in the exposing zone 14, whereby a latent electrostatic image corresponding to the document is formed on the photosensitive material. Thereafter, in the developing zone 16, the developing device 26 applies toner to the latent electrostatic image on the photosensitive material to develop it to a toner image. Then, in the transfer zone 18, a copying paper sent from the paper feed means (the first paper feed device 50*a*, the second paper feed device 50*b* or the third paper feed device 50*c*) as stated above is brought into contact with the photosensitive material, and by the action of the transfer corona discharger 28, the toner image on the photosensitive material is transferred to the surface of the copying paper. Then, in the peeling zone 20, the paper is peeled from the photosensitive material by the action of the peeling corona discharger 30. After the peeling of the paper, the rotating drum 8 continues to rotate, and in the cleaning zone 22, the toner particles remaining on the photosensitive material after transfer are removed by the action of the cleaning blade 46 of the cleaning device 32. In the meantime, the copying paper having the toner image transferred thereto is then conveyed to the fixing device 96 where the toner image is fixed under heat. In the case of one-side copying or when a copied image has been formed on both sides of paper in both-side copying, the paper having the toner image fixed thereto advances over the switch-over guide members 134 and 136 and is discharged into the receiving tray 142. When a copied image has been formed only on one side of paper in both side copying, the paper having the fixed toner image is conducted to the intermediate stock portion 149 in the manner described above. The paper stocked in the intermediate stock portion 149 is then sent to the upstream portion of the paper conveying mechanism 48, and then copying is performed on the other side of the paper as mentioned above. The paper is then discharged into the receiving tray 142.

Figure 2:
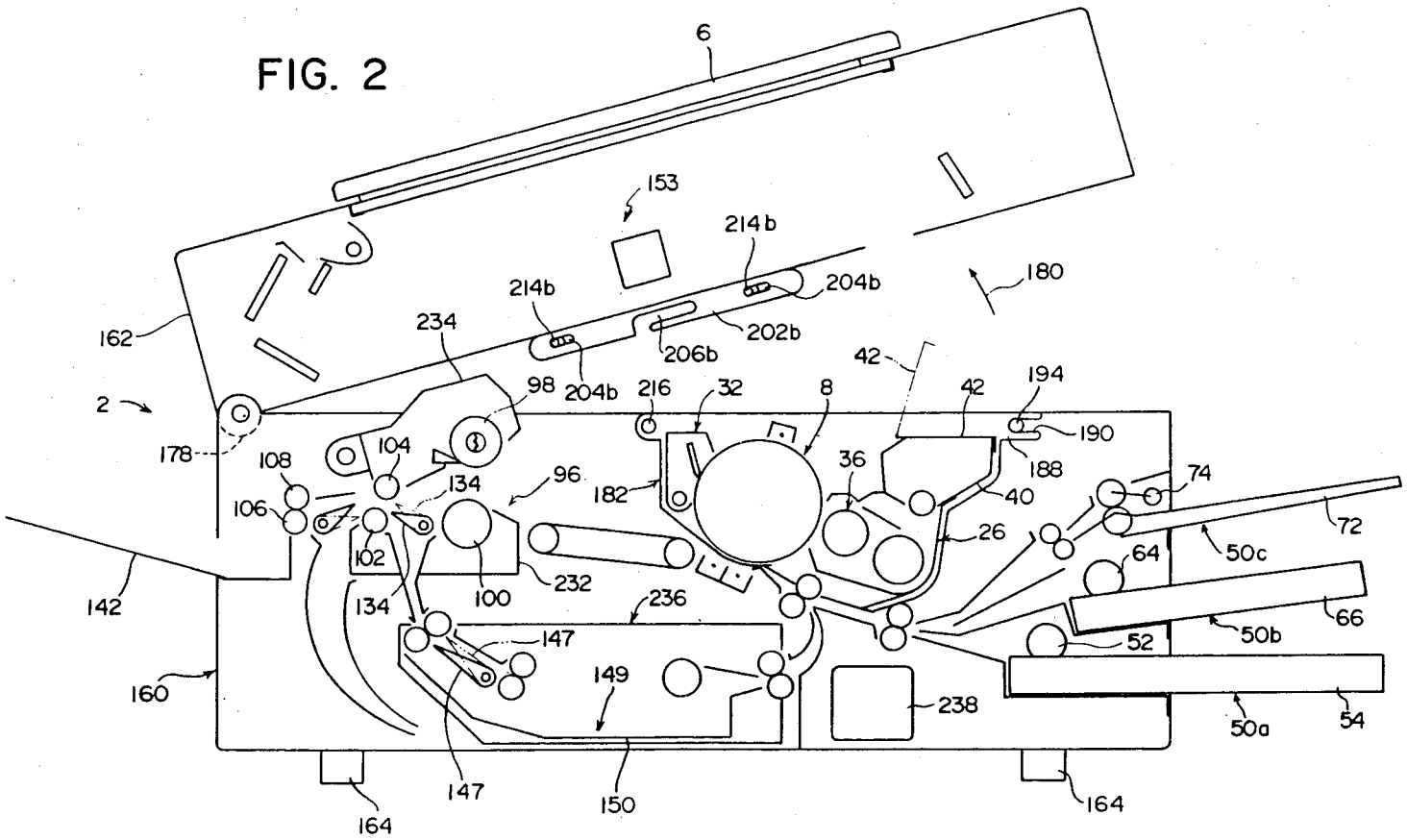
FIG. 2 is a simplified sectional view showing that the upper supporting frame of the electrostatic copying apparatus of FIG. 1 is held at an open position.
Figure 3:
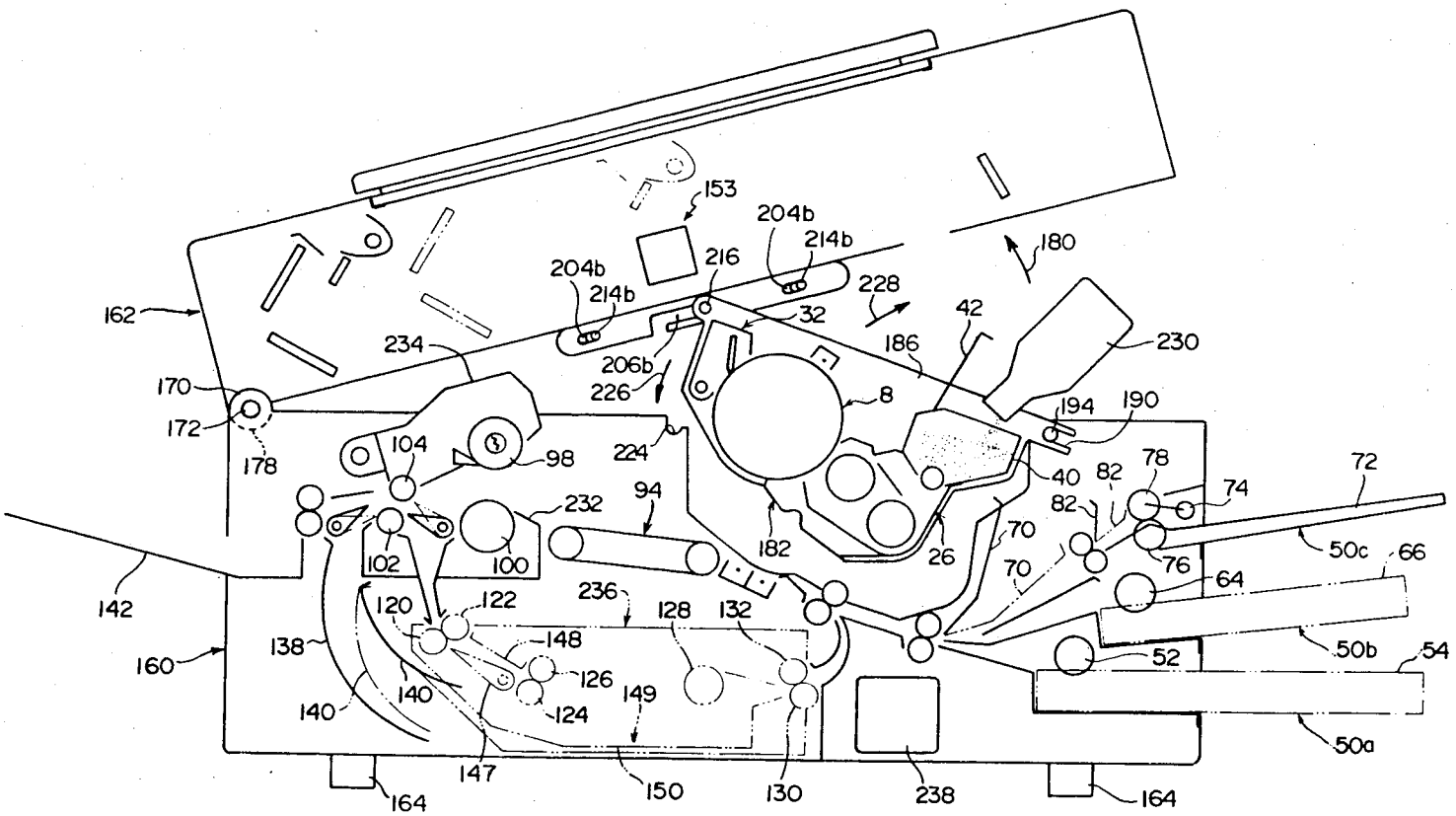
FIG. 3 is a simplified sectional view showing that the upper supporting frame of the electrostatic copying apparatus of FIG. 1 is held at an open position and the supporting unit frame is held at a second position.
Figure 4:
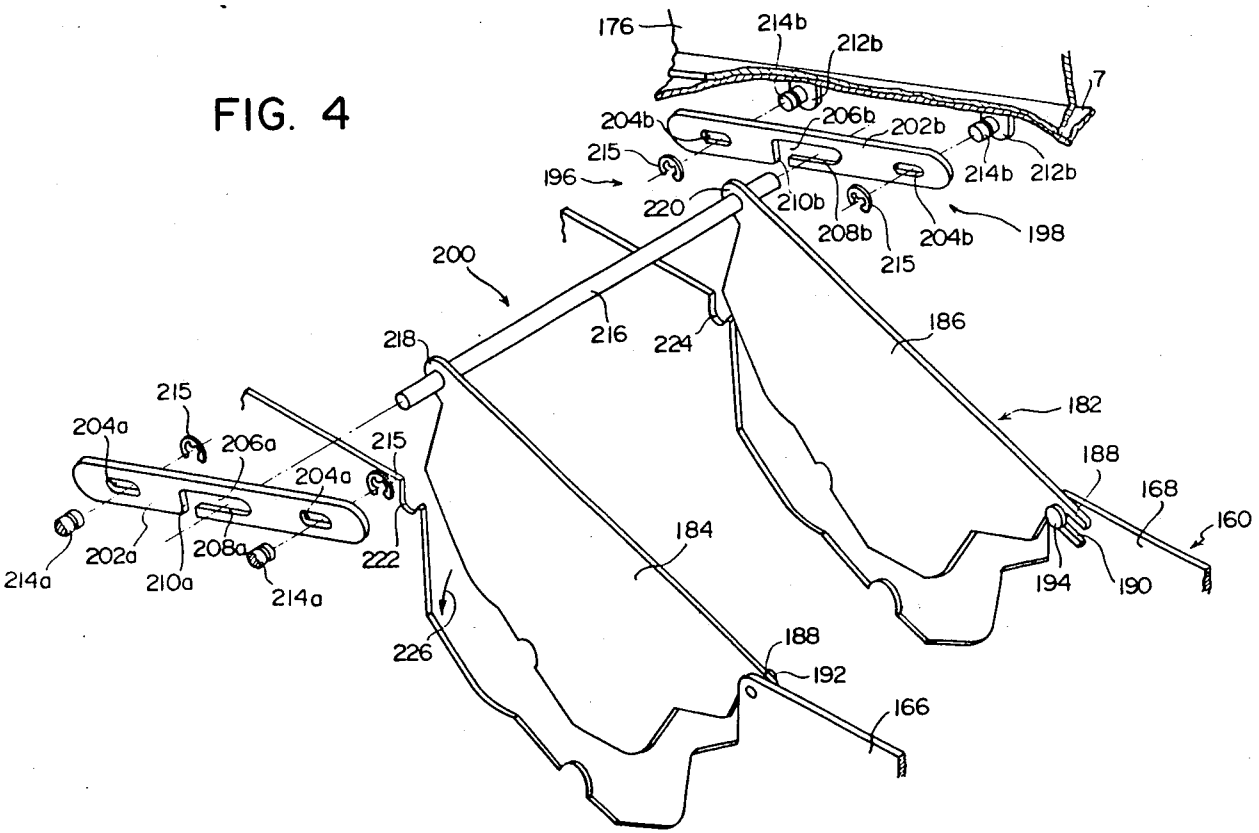
FIG. 4 is a perspective view showing the supporting unit frame of the electrostatic copying apparatus of FIG. 1 and its vicinity in a partly disassembled state.

As can be easily understood from FIGS. 2 and 3, the electrostatic copying apparatus shown in FIG. 1 has a so-called shell-type supporting structure comprised of a lower supporting frame 160 and an upper supporting frame 162 mounted pivotably on the lower supporting frame 160. With reference to FIGS. 2 and 3 together with FIG. 1, a copying paper feed means is disposed in one end side of the supporting structure, namely on the right side in FIGS. 1 to 3, and the receiving tray 142 is provided in the other end side of the supporting structure, i.e. on the left side in FIGS. 1 to 3. The paper conveying mechanism extends right-to-left in FIGS. 1 to 3 from its one end to its other end. Supporting legs 164 are provided on the under surface of the lower supporting frame 160 of the supporting structure. By positioning the supporting legs 164 on a supporting table (not shown) or the like, the lower supporting frame 160 is set in position. With reference also to FIG. 4, the lower supporting frame 160 has a vertical front base plate 166 and a vertical rear base plate 168 spaced from each other in the front-back direction (in a direction perpendicular to the sheet surface in FIGS. 1 to 3, and in a direction from left bottom toward right top in FIG. 4). A supporting projection 170 projecting upwardly is provided in the other end portion (the discharge side portion of the copying apparatus), which is the other end of the supporting structure, of each of the vertical front base plate 166 and the vertical rear base plate 168 of the lower supporting frame 160, and a supporting pin 172 is fixed to the supporting projection 170 (in FIGS. 1 to 3, only the supporting projection 170 and the supporting pin 172 in the vertical rear base plate 168 are shown). A supporting pin (not shown) fixed to the vertical front base plate 166 projects slightly forwardly from the front surface of the vertical front base plate 166. The supporting pin 172 fixed to the vertical rear base plate 168 projects slightly rearwardly from the rear surface of the vertical rear base plate 168.

The upper supporting frame 162 also includes a vertical front base plate 174 (see FIGS. 5-A to 5-C) and a vertical rear base plate 176 (see FIG. 4) spaced from each other in the front-back direction (a direction perpendicular to the sheet surface in FIGS. 1 to 3, and in a direction from left bottom toward right top in FIG. 4). The distance between the vertical front base plate 174 and the vertical rear base plate 176 of the upper supporting frame 162 in the front-back direction is slightly larger than the distance between the vertical front base plate 166 and the vertical rear base plate 168 of the lower supporting frame 160 in the front-back direction. Hence, the vertical front base plate 174 and the vertical rear base plate 176 of the upper supporting frame 162 are positioned slightly forwardly and rearwardly of the vertical front base plate 166 and the vertical rear base plate 168 of the lower supporting frame 160 respectively. For the vertical front base plate 166 of the lower supporting frame 160 and the vertical front base plate 174 of the upper supporting frame 162. Supporting projections 178 projecting downwardly are provided respectively in the other end portions (the discharge side portion of the copying apparatus), which are the aforesaid other end of the supporting structure, of the vertical front base plate 174 and the vertical rear base plate 176 of the upper supporting frame 162, and a hole is formed in each of the supporting projections 178. The hole formed in the supporting projection 178 of the vertical front base plate 174 of the upper supporting frame 162 is received by the supporting pin fixed to the vertical front base plate 166 of the lower supporting frame 160, and the hole formed in the supporting projection 178 of the vertical rear base plate 176 of the upper supporting frame is received in the supporting pin 172 fixed to the vertical rear baseplate 168 of the lower supporting frame 160 (FIGS. 1 to 3 show only those at the vertical rear base plates 168 and 176). Because of this structure, the upper supporting frame 162 is mounted on the lower supporting frame 160 for free pivotal movement about the central axis of the supporting pin 172 (the central axis constitutes a first pivot axis extending in the front-back direction), and can pivot freely between a closed position shown in FIG. 1 and an opening position shown in FIGS. 2 and 3 about the supporting pin 172 existing in the aforesaid other end of the supporting structure as a fulcrum. In the illustrated embodiment, a spring means (not shown) for elastically biasing the upper supporting frame 162 with respect to the lower supporting frame 160 in the direction shown by an arrow 180 (FIGS. 2 and 3) is interposed between the lower supporting frame 160 and the upper supporting frame 162. Furthermore, a locking means for locking the upper supporting frame 162 in the aforesaid closed position against the elastic biasing action of the spring means is provided in the lower supporting frame 160 and the upper supporting frame 162. The spring means and the locking means may be substantially the same as those disclosed, for example, in the specification of Japanese Laid-Open Patent Publication No. 188670/1984.

As can be understood from FIGS. 1 to 3, a supporting unit frame 182 (the details of which will be described hereinafter) is pivotably mounted on the lower supporting frame 160 in the electrostatic copying apparatus described above. It will be seen from FIGS. 1 to 3 that in the specific embodiment, the horizontal plate 7 and constituent elements located above the horizontal plate 7 (the document holder 6, the transparent plate 4, the optical system 153, etc.) are mounted on the upper supporting frame 162, and constituent elements located below the horizontal plate 7 (the copying paper feed means, the copying paper conveying mechanism 48, the copying paper reversing-conveying mechanism 118, the transfer corona discharger 28, the peeling corona discharger 30, etc.) are mounted on the lower supporting frame 160. Among the constituent elements located below the horizontal plate 7, the rotating drum 8, the charging corona discharger 24, the developing device 26 and the cleaning device 32 are mounted on the supporting unit frame 182 mounted pivotably on the lower supporting frame 160.

The supporting unit frame 182 will now be described mainly with reference to FIG. 4. The illustrated supporting unit 182 has a front wall 184 and a rear wall 186 spaced from each other in the front-back direction (in a direction perpendicular to the sheet surface in FIGS. 1 to 3, and in a direction from left bottom toward right top in FIG. 4). The distance between the front wall 184 and the rear wall 186 of the supporting unit frame 182 in the front-back direction is slightly smaller than the distance between the vertical front base plate 166 and the vertical rear base plate 168 of the lower supporting frame 160 in the front-back direction. Accordingly, the front wall 184 and the rear wall 186 of the supporting unit frame 182 are positioned slightly rearwardly and frontwardly of the vertical front base plate 166 and the vertical rear base plate 168 of the lower supporting frame 160, respectively (see FIGS. 5-A to 5-C also). A protrusion 188 projecting toward one end of the supporting structure, namely to the right in FIGS. 1 to 3, is provided at one end portion (one end of the supporting structure) of each of the front wall 184 and the rear wall 186 of the supporting unit frame 182, and a U-shaped cut 190 is formed in the protrusion 188 (FIGS. 1 to 4 show only that cut 190 which is formed in the rear wall 186). On the other hand, a rearwardly projecting supporting pin 192 is fixed to the rear surface of the vertical front base plate 166 of the lower supporting frame 160, and a forwardly projecting supporting pin 194 is fixed to the front surface of the vertical rear base plate 168 of the lower supporting frame 160. Hence, the cut formed in the front wall 184 of the supporting unit frame 182 is detachably received by the supporting pin 192 fixed to the vertical front base plate 166 of the lower supporting frame 160, and the cut 190 formed in the rear wall 186 of the supporting unit frame 182 is detachably received by the supporting pin 194 fixed to the vertical rear base plate 168 of the lower supporting frame 162. Thus, the supporting unit frame 182 is detachably mounted on the lower supporting frame 160, and can freely pivot between a first position shown in FIGS. 1 and 2 and a second position shown in FIG. 3 about the supporting pin 194 (the axis of the supporting pin 194 constitutes a second pivot axis extending in the front-back direction substantially parallel to the first pivot axis mentioned above) as a center. As is seen from FIGS. 1 to 3, constituent elements mounted on the supporting unit frame 182 (the rotating drum 8, the developing device 26, the cleaning device 32, etc.) are mounted between the front wall 184 and the rear wall 186, and although not shown in the drawings, the rotating drum 8, the developing device 26, the cleaning device 32 and the charging corona discharger 24 are detachably mounted there. As is seen from FIG. 3, in this specific embodiment, the upper supporting member 162 can freely pivot on a fulcrum at the other end of the supporting structure. Furthermore, since the developing device 26 is provided at one end (the right end in FIGS. 1 to 3) of the supporting unit frame 182 and the rotating drum 8 is provided at the other end (the left end in FIGS. 1 to 3) of the supporting unit frame 182 with respect to the developing device 26, the supporting unit frame 182 is free to pivot about its one end as a fulcrum.

The above electrostatic copying apparatus further includes a connecting means 196 for connecting the supporting unit frame 182 to the upper supporting frame 162, and in the illustrated embodiment, the connecting means 196 connects the supporting unit frame 182 releasably to the upper supporting frame 162.

With reference to FIGS. 5-A to 5-C in conjunction with FIG. 4, the illustrated connecting means 196 has an engaging means 198 and an engage means 200 adapted to come into and out of engagement with the engaging means 198. In the illustrated embodiment, the engaging means 198 is provided in the upper supporting frame 162, and the engage means 200, in the supporting unit frame 182. Alternatively, it is possible to provide the engage means in the upper supporting frame 162 and the engaging means in the supporting unit frame 182. The illustrated engaging means 198 includes a pair of moving means 202*a* and 202*b*. The moving member 202*a* is attached to the vertical front base plate 174 of the upper supporting frame 162, and the moving member 202*b*, to the vertical rear base plate 176 of the upper supporting frame 162. The moving members 202*a* and 202*b* are substantially of the same structure, and longitudinally extending long holes 204*a* and 204*b* are formed in the opposite end portions of each of these moving members 202*a* and 202*b*. L-shaped openings 206*a* and 206*b* are formed centrally in the moving members 202*a* and 202*b*, respectively. The openings 206*a* and 206*b* respectively have long hole portions 208*a* and 208*b* and opening portions 210*a* and 210*b* opened at the lower ends and extending downwardly from the left ends (the left ends in FIGS. 2 to 4) of the long hole portions 208*a* and 208*b*. The lengths of the long hole portions 208*a* and 208*b* are made slightly larger than those of the long holes 204*a* and 204*b*, respectively. On the other hand, a pair of downwardly extending portions 212*a* and a pair of downwardly extending portions 212*b*, the members of each pair being spaced from each other in the lateral direction (the left-to-light direction in FIGS. 1 to 3, the direction extending from right bottom toward left top in FIG. 4, and in the direction perpendicular to the sheet surface in FIGS. 5-A to 5-C), are provided at the front end and the rear end respectively of the horizontal plate 7 mounted on the lower end portion of the upper supporting frame 162 (FIG. 4 shows the rear end portion of the horizontal plate 7, and FIGS. 5-A to 5-C show the front end portion of the horizontal plate 7). Rearwardly projecting pins 214*a* are provided in the pair of downwardly extending portions 212*a* provided at the front end of the horizontal plate 7, and forwardly projecting pins 214*b* are provided in the pair of downwardly extending portions 212*b* at the rear end of the horizontal plate 7. At the vertical front base plate 174 of the upper supporting frame 162, the long holes 204*a* formed in the opposite end portions of the moving member 202*a* are slidably received by the pins 214*a* fixed to the downwardly extending portions 212*a* of the horizontal plate 7. At the vertical rear base plate 176 of the upper supporting frame 162, the long holes 204*b* formed in both end portions of the other moving member 202*b* are slidablly received by pins 214*b* fixed to the downwardly extending portions 212*b* of the horizontal plate 7. An anchoring member 215 is attached to the end portion of each of the pins 214*a* and the pins 214*b*. With the above structure, therefore, the moving members 202*a* and 202*b* are free to move laterally between a position (an engaging position shown in FIG. 3) at which each of the pins 214*a* and 214*b* abuts against one end of each of the long holes 204*a* and 204*b* and a position (a non-engaging position shown in FIG. 2) at which each of the pins 214*a* and 214*b* abuts against the other end of each of the long holes 204*a* and 204*b*. Preferably, the moving members 202*a* and 202*b* are made movable simultaneously from the front side of the copying apparatus by coupling them to each other through an interlocking mechanism (not shown).

The illustrated engage means 200 is comprised of a shaft member 216 extending in the front-back direction. Projecting portions 218 and 220 projecting to the left in FIGS. 1 to 3 (toward the other end of the supporting structure) are provided respectively at the other end portions (the other end side of the supporting structure) of the front wall 184 and the rear wall 186 of the supporting unit frame 182, and the shaft member 216 is mounted across the projecting portions 218 and 220. As shown in FIGS. 4 and 5-A to 5-C, the front end of the shaft member 216 further projects forwardly beyond the front wall 184, and the rear end of the shaft member 216 further projects rearwardly beyond the rear wall 186. The shaft member 216 is adapted to come into and out of engagement with the openings 206*a* and 206*b* of the moving members 202*a* and 202*b*. When the upper supporting member 162 is held at the closed position and the moving members 202*a* and 202*b* are brought to the non-engaging position shown in FIG. 2, the opposite end portions of the shaft member 216 (the forwardly projecting end portion located forwardly of the front wall 184 and the rearwardly projecting end portion located rearwardly of the rear wall 186) are positioned within the opening portions 210*a* and 210*b* of the openings 206*a* and 206*b*, whereby the shaft member 216 comes out of engagement with the moving members 202*a* and 202*b*. When the moving member 202*a* and 202*b* are held at the engaging position shown in FIG. 3, the aforesaid opposite end portions of the shaft member 216 are positioned in the intermediate portions, in the longitudinal direction, of the long hole portions 208*a* and 208*b* of the openings 206*a* and 206*b* respectively, whereby the shaft member 216 comes into engagement with the moving members 202*a* and 202*b*. In this state of engagement, the relative movement of the shaft member 216 and the moving members 202*a* and 202*b* is permitted within a predetermined range. In relation to the shaft member 216, a receiving portion for supporting the shaft member 216 is provided in the lower supporting frame 160. The illustrated receiving portion consists of a nearly U-shaped depression 222 formed in the upper end of the vertical front base plate 166 of the lower supporting frame 160 and a nearly U-shaped depression 224 formed in the upper end of the vertical rear base plate 168 of the lower supporting frame 160. The depressions 222 and 224 support the opposite end portions of the shaft member 216 (more specifically, that part of the forwardly projecting end portion which is inwardly of the site engaging the moving member 212*a*, and that part of the rearwardly projecting end portion which is inwardly of the site engaging the moving member 212*b*) when the supporting unit frame 182 is at the first position shown in FIGS. 1 and 2 (see FIGS. 5-A and 5-C in particular).

Now, with reference to FIGS. 5-A to 5-C in conjunction with FIGS. 1 to 3, the opening-closing operation of the upper supporting frame 162 will be described.

When the upper supporting frame 162 is at the closed position, the upper supporting frame 162, the lower supporting frame 160 and the supporting unit frame 182 mounted on the lower supporting frame 160 are maintained in the positional relation shown in FIGS. 1 and 5-A. Specifically, the supporting unit frame 182 is also held at the first position, and the opposite end portions of the shaft member 216 of the supporting unit frame 182 are supported by the depressions 222 and 224 formed in the vertical front base plate 166 and the vertical rear base plate 168 of the lower supporting frame 160. Hence, the various constituent elements mounted on the lower supporting frame 160 (the copying paper feed device, the copying paper conveying mechanism 48, the copying paper reversing-conveying mechanism 118, etc.), the various constituent elements mounted on the supporting unit frame 182 (the rotating drum 8, the developing device 26, etc.) and the various constituent elements mounted on the upper supporting frame 162 (the optical system 152, etc.) are held at the position shown in FIG. 1. In this state, the copying operation becomes possible as stated hereinabove.

When the rotating drum 8 or the developing device 26 is to be detached from the supporting unit frame 182 or toner particles are to be supplied to the toner particle receptacle 40 of the developing device 26, the moving members 202*a* and 202*b* are brought to the non-engaging position shown in FIG. 2 to pivot the upper supporting frame 162 from the above closed position to the direction shown by an arrow 180 (FIG. 2). Since the shaft member 216 is out of engagement with the moving member 202*a* and 202*b*, the upper supporting frame 162 is pivoted in the direction of arrow 180 about the supporting pin 172 (the first pivot axis) as a center as shown in FIGS. 2 and 5-B (since in this state, the supporting unit frame 182 is supported at one end by the supporting pins 192 and 194, and at the other end by the depressions 222 and 224 of the lower supporting frame 160 via the shaft member 216, and therefore, the supporting unit frame 182 is held at the first position shown in FIG. 2). When the upper supporting frame 162 so pivoted is held at the open position shown in FIG. 2, the upper surface of the lower supporting frame 160 is opened as shown in FIG. 2. Because in the copying apparatus described above, the paper conveying mechanism 48 extends substantially perpendicularly to the front-back direction and the upper supporting frame 162 is pivoted on a fulcrum at the paper discharge side portion of the copying apparatus, the paper-feed side portion of the apparatus is opened especially widely to leave a sufficient space above the paper feed side of the lower supporting frame 160. By utilizing this space, the rotating drum 8, the developing device 26 and the supporting unit frame 182 can be mounted and detached very easily. The rotating drum 8 and the developing device 26 can be detached from the supporting unit frame 182 by lifting them as desired, and can be mounted by inserting them from above into the space between the front wall 184 and the rear wall 186 of the supporting unit frame 182. The supporting unit frame 182 can be detached from the lower supporting frame 160 by slightly lifting the other end of the supporting unit frame 182, moving it to the left in FIG. 2 (consequently, as seen from FIGS. 2 and 4, the supporting pins 192 and 194 fixed to the lower supporting frame 160 come out of engagement with the cuts 190 formed in the front wall 184 and the rear wall 186 of the supporting unit frame 182) and then lifting it further. The supporting unit frame 182 can be mounted on the lower supporting frame 160 by positioning it properly between the vertical front base plate 166 and the vertical rear base plate 168 of the lower supporting frame 160, causing the cuts 190 of the supporting unit frame 182 to engage the supporting pins 192 and 194 of the lower supporting frame 160, and pivoting the supporting unit frame 182 downwardly in the direction of an arrow 226 (FIGS. 3 and 4). The supporting unit frame 182 can be mounted and detached while the various constituent elements (the rotating drum 8, the developing device 26, etc.) are mounted on it. When the upper supporting frame 162 is at the open position, the surface of the photosensitive material on the upper part of the rotating drum 8 (as can be seen from FIG. 1, the surface of the photosensitive material undergoes a cleaning action by the cleaning device 32 but does not undergo a developing action by the developing device 26) can be easily viewed through the aforesaid space. Accordingly, it is very easy to confirm the cleaning action of the cleaning device 32. Furthermore, since a wide open space is also provided above the toner particle receptacle 40 of the developing device 26, the amount of the remaining toner particles within the receptacle 40 can be easily determined through the above space by opening the closure 42 as shown by a two-dot chain line in FIG. 2. This also permits easy supplying of toner particles. Furthermore, as can be seen from the following description, a starting developer composed of toner particles and carrier particles can also be supplied through the toner receptacle 40 while keeping the copying apparatus in operation. In this state, the downstream side of the copying paper conveying mechanism 48 is also opened as shown in FIG. 2, and any paper that has jammed up in this portion can be easily removed through the aforesaid space.

In opening that part of the paper conveying mechanism 48 which is present below the supporting unit frame 182, the moving members 202*a* and 202*b* are held in the engaging position shown in FIG. 3 and the upper supporting frame 162 is pivoted in the direction of arrow 180 (FIG. 3) from the closed position. As a result, the moving members 202*a* and 202*b* come into engagement with the shaft member 216, and as shown in FIGS. 3 and 5-C, the upper supporting frame 162 is pivoted in the direction of arrow 180 about the supporting pin 172 (the first pivot axis) as a center, and following the pivoting movement of the upper supporting frame 162, the supporting unit frame 182 is pivoted in the direction shown by an arrow 228 (FIG. 3) about the supporting pins 192 and 194 (the second pivot axis) as a center. In the illustrated embodiment, the moving members 202*a* and 202*b* and the shaft member 216 can move relative to each other even when they are kept in engagement with each other. Hence, even when the upper supporting frame 162 is turned in the direction of arrow 180, the supporting frame 182 in the direction of arrow 228 is allowed to pivot (at this time, the shaft member 216 of the supporting unit frame 182 moves relatively toward one side end, namely to the right in FIGS. 3 and 4, within the long hole portions 208*a* and 208*b* of the openings 206*a* and 206*b* formed in the moving members 202*a* and 202*b*). When the upper supporting frame 162 is held at the open position shown in FIG. 3 by this pivoting movement, the upper surface of the lower supporting frame 160 and a space below the supporting unit frame 182 are opened as shown in FIG. 3.

Furthermore, since in the aforesaid copying apparatus the paper conveying mechanism 48 extends substantially perpendicularly to the front-back direction and the supporting unit frame 182 is pivoted about its one end, namely its paper feed side end, a space below the rotating drum 8 disposed at the other end portion of the supporting unit frame 182 with respect to the developing device 26 (generally paper jamming occurs frequently at this part) is widely opened, and the upper surface of the supporting unit frame 182 inclines downwardly toward the paper-feed side of the copying apparatus and lies in the space between the lower supporting frame 160 and the upper supporting frame 162. Accordingly, in the event of paper jamming at a part below the supporting unit frame 182 of the paper conveying mechanism 48, the paper can be easily removed from it. Furthermore, in this state, since the upper surface of the supporting unit frame 182 faces the widely opened space between the lower supporting frame 160 and the upper supporting frame 162, the mounting and detaching of the rotating drum 8 and the developing device 26, the confirmation of the cleaning action, the determination of the amount of the remaining toner particles, and the supply of the toner particles become easier, as can be readily understood from a comparison of FIG. 2 with FIG. 3. For example, in the supplying of the toner particles, the upper opening of the toner particle receptacle 40 is slightly inclined toward the widely opened space, and by utilizing this space, the toner particles can be supplied very easily from a toner container 230.

The electrostatic copying apparatus described above is improved in the following respects in order to remove paper jamming easily in the paper conveying mechanism 48, the paper reversing-conveying mechanism 118, etc.

With reference mainly to FIG. 3, the illustrated fixing device 96 has a lower supporting member 232 mounted on the lower supporting frame 160 and an upper supporting member 234 mounted on the lower supporting frame 160 so as to pivot freely between a closed position (the position shown in FIG. 1) and an open position (the position shown in FIGS. 2 and 3) about its downstream end portion (the left end portion in FIGS. 1 to 3) as a fulcrum. The lower roller 100 and the switch-over conveying roller 102 are rotatably mounted on the lower supporting member 232, and the upper roller 98 and the switch-over conveying roller 104 are mounted rotatably on the upper supporting member 234. The switch-over guide member 134 is also mounted on the lower supporting member 232. Hence, when the upper supporting member 162 is held at the open position as stated above (the upper supporting frame 162 alone is held at the open position or the upper supporting frame 162 is held at the open position and simultaneously the supporting unit frame 182 is held at the second position), the upper supporting member 234 is held at the open position by the action of spring means (not shown) interposed between the lower supporting member 232 and the upper supporting member 234. As a result, the nipped state between the upper roller 98 and the lower roller 100 and between the switch-over conveying rollers 102 and 104 is cancelled, and a paper sheet which has jammed up between the rollers 98 and 100, between the rollers 102 and 104, and in their neighborhood can be easily removed through the space between the lower supporting frame 160 and the upper supporting frame 162 at the open position. When the upper supporting frame 162 is held at the closed position, its lower end portion acts on the upper surface of the upper supporting member to hold the upper supporting member 234 at the closed position.

The intermediate stock portion 149 is constructed as a unit, and the intermediate tray 150, the pair of conveying roller units 120 and 122, the pair of conveying roller units 124 and 126, the guide plate 148, the oscillating guide member 147, the feed roller 128 and the pair of conveying roller units 130 and 132 are mounted on the unit frame 236. The unit frame 236 is mounted on the lower supporting frame 160 so that it can move freely in the front-back direction between a drawn position at which it is situated forwardly of the vertical front base plate 166 (FIG. 4) of the lower supporting frame 160 and an operative position at which it is situated between the vertical front base plate 166 and the vertical rear base plate 168 of the lower supporting frame 160 (when the unit frame 236 is at the operative position, both-side copying becomes possible, and a paper sheet having a copied image on one side and fed from the switch-over conveying roller units 102 and 104 is conducted to the intermediate tray 150 by the action of the conveying rollers 120, 122 and 124, 126 (in relation to this, an opening of a suitable shape corresponding to the unit frame 236 is formed in the vertical front base plate 166 and the vertical rear base plate 168 of the lower supporting frame 160). Accordingly, when the unit frame 236 is held at the drawn position by moving it in the front-back direction, it is positioned forwardly of the lower supporting frame 160 to permit easy removal of a paper sheet that has jammed up in the intermediate stock portion 149 and its vicinity (FIG. 3 shows the apparatus when the unit frame 236 is at the operative position, and when the unit frame 236 is brought to the drawn position, a space forms in a part shown by a two-dot chain line).

One guiding-holding plate 140 of the pair of guiding-holding plates 138 and 140 constituting the holding portion for switching over the conveying direction is mounted pivotably about its upper end portion (that end portion which faces the switch-over guide member 136) as a fulcrum. Hence, by holding the unit frame 236 of the stock portion at the drawn position, the guiding-holding plate 140 can be opened as shown by a solid line in FIG. 3 through an opening (not shown) formed in the vertical front base plate of the lower supporting frame 160 and the space formed by the drawing action, and any paper which has jammed up in the switch-over holding portion can be easily removed.

In relation to the third paper feed device 50*c*, the guide plate 82 and the guide plate 70 are mounted pivotably about their lower end portions (end portions on the side of the conveying roller units 60 and 62) as a fulcrum. Hence, the guide plates 82 and 70 can be opened as shown by a solid line in FIG. 3 through the space between the lower supporting frame 160 and the upper supporting frame 162 at the open position by holding the upper supporting frame 162 at the open position (holding only the upper supporting frame 162 at the open position, or holding the upper supporting frame 162 at the open position and simultaneously holding the supporting unit frame 182 at the second position). As a result, a paper sheet that has jammed up in these parts can be easily removed.

When paper jamming occurs in the cassette-receiving sections of the first paper feed device 50*a* and the second paper feed device 50*b* and in their neighborhood, the paper can be easily removed through the opening formed in the right wall of the housing 2 by detaching the paper cassettes 54 and 56 from the housing 2 in the required manner. (FIG. 3 shows by a two-dot chain line that the copying paper cassettes 54 and 56 are mounted detachably).

Figure 6:
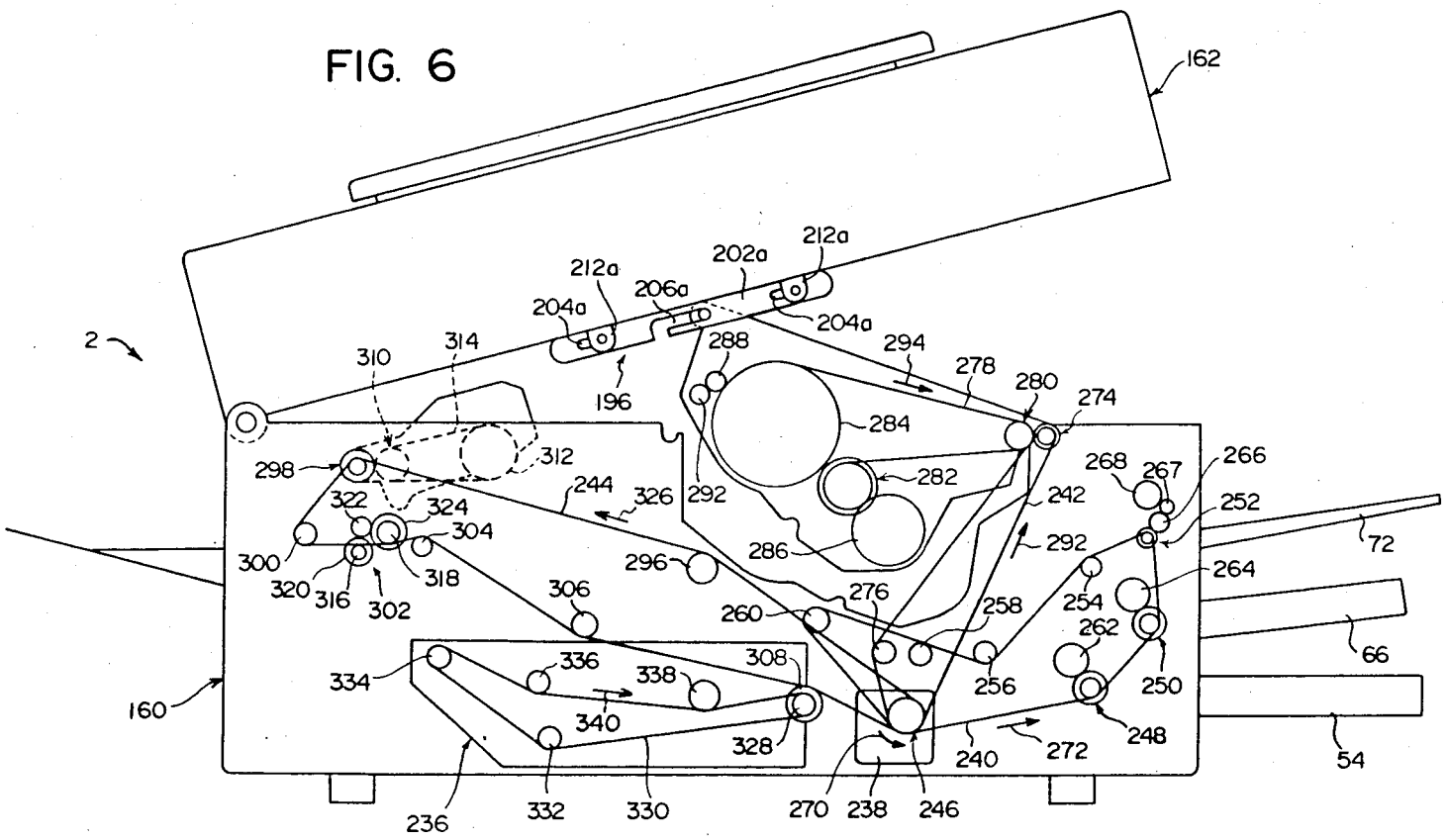
FIG. 6 is a rough view showing a driving system for the electrostatic copying apparatus of FIG. 1 as viewed from the front side of the apparatus.

A driving system for the electrostatic copying apparatus described hereinabove will now be described with reference to FIG. 6. In FIG. 6 which shows the driving system as viewed from the front side for comparison with FIGS. 1 to 3, the driving system is disposed on the back surface of the vertical rear base plate 168 of the lower supporting frame 160 and the back surface of the rear wall 186 of the supporting unit frame 182 and includes a driving source 238 such as an electric motor constituting a main driving source for the copying apparatus. A first endless power transmission member 240, a second endless power transmission member 242 and a third endless power transmission member 244 extend from the driving source 238 mounted on the lower supporting frame 160. The first power transmission member 240 which may be comprised of, for example, a chain is wrapped about the sprocket portion of a multistage sprocket (three-stage sprocket in the illustrated embodiment) fixed to the output shaft of the driving source 238, the sprocket portion of a linking member 248, the sprocket portion of a linking member 250 and the sprocket portion of a linking member 252. It is further wrapped over sprockets 254, 256, 258 and 260 and returns to the multistage sprocket 246. The gear portion of the linking member 248 is in mesh with a gear 262 which is drivingly connected to the feed roller 52 via a clutch means (not shown). Furthermore, the gear portion of the linking member 252 is in mesh with a gear 266 which is drivingly connected to the separation roller 76 via a clutch means (not shown). The gear 266 is in mesh with a gear 268 which is drivingly connected to the separation roller 78 via a gear 267. The feed roller 74 is drivingly connected to the gear 268 via a suitable power transmission mechanism (not shown). To the sprocket 254 is drivingly connected the conveying roller 84 via a clutching means (not shown), and the conveying roller 60 is drivingly connected to the sprocket 258 via a clutch means (not shown). The conveying roller 90 is drivingly connected to the sprocket 260. The clutch means provided in the conveying roller 60 becomes operative when part of the optical system 153 arrives at a predetermined position during its scanning movement, and consequently, the pair of conveying roller units 60 and 62 start to convey a copying paper sheet in synchronism with the rotation of the rotating drum 8). Hence, when the driving source 238 is actuated, the multistage sprocket 246 is rotated in the direction shown by an arrow 270 to move the first power transmission member 240 in the direction shown by an arrow 272. As a result, the various rollers for paper conveyance are rotated so as to convey the copying paper in the manner described hereinabove.

The second power transmission member 242 which may be formed of, for example, a chain is wrapped over the sprocket portion of the multistage sprocket 246, the sprocket portion of a linking member 274 and a sprocket 276 and returns to the multistage sprocket 246. The axis of rotation of the linking member 274 is in alignment with the second pivot axis of the supporting unit frame 182. An endless power transmission member 278 such as a chain is wrapped over the sprocket portion of a linking member 280 mounted on the rear wall 186 of the supporting unit frame 182 the sprocket portion of a linking member 282 and further a sprocket 284 mounted on the rear end of the rotating drum 8 and returns to the linking member 280. The linking member 274 and the linking member 280 are drivingly connected by bringing their gear portions into mesh with each other. When the supporting unit frame 182 is kept at the second position pivoted from the first position, it can be pivoted while the gear portions of the linking members is maintained in engagement. The linking member 282 is drivingly connected to the magnetic brush mechanism 36 of the developing device 26, and the gear portion of the linking member 282 is in mesh with a gear 286 drivingly connected to the agitating mechanism 38. The toner particle supply roller 44 of the developing device 26 is rotated by a driving source for exclusive use (not shown). A gear portion is provided at the rear end portion of the rotating drum 8. This gear portion is in mesh with a gear 292 drivingly connected through a gear 288 to moving means 290 (see FIG. 1) for moving toner particles removed from the surface of the rotating drum 8 in a predetermined direction. Thus, when the driving source 238 is actuated, the second moving member 242 is moved in the direction shown by an arrow 292 by the multistage sprocket 246 rotated in the direction of arrow 270, whereby , the power transmission member 278 is moved in the direction shown by an arrow 294 via the linking members 274 and 280. As a result, the rotating drum 8 is rotated in the direction of arrow 10 (FIG. 1), and the magnetic brush mechanism 36 and the agitation mechansim 38 are also rotated in the required manner.

The third power transmission member 244 which can be formed of, for example,a chain is wrapped over the sprocket portion of the multistage sprocket 246, a sprocket 296, the sprocket portion of a linking member 298, and a sprocket 300, and further a normal and reverse rotation mechanism 302. Then, it is wrapped over sprockets 304, 306 and 308 and returns to the multistage sprocket 246. The sprocket 296 is drivingly connected to the driving roller (the right roller in FIGS. 1 to 3) of the conveying belt mechanism 94. The axis of rotation of the linking member 298 is in alignment with the pivot axis of the upper supporting member 234 of the fixing device 96. The gear portion of the linking member 298 is in mesh with the gear portion of a linking member 310, and drivingly connected to a sprocket 312 of the linking member 310 via a power transmission member 314 such as a chain. The sprocket 312 is drivingly connected to the upper roller 98 of the fixing device 96. Hence, when the upper supporting frame 162 is held at the open position, the upper supporting member 234 is held at the open position while the gear portion of the linking member 298 is in engagement with the gear portion of the linking member 310, as can be seen from FIG. 6. The normal and reverse rotation mechanism 302 includes sprockets 316 and 318 wrapped over the third power transmission member 244. The sprocket 316 is drivingly connected to a gear 320 via a clutch means (not shown). The gear 320 is drivingly connected to a gear 324 via a gear 322. The sprocket 318 is drivingly connected to the gear 324 via a clutch means (not shown), and the gear 324 is drivingly connected to the switch-over conveying roller 102. The normal and reverse rotation mechanism 302 of this structure is known per se, and by selectively operating two clutch means (not shown), the switch-over conveying roller 102 is rotated in the normal or reverse direction. The sprocket 300 is drivingly connected to the discharge roller 106. With the foregoing structure, when the driving source 238 is actuated, the third power transmission member 244 is moved in the direction shown by an arrow 326 by the multistage sprocket 246 rotated in the direction of arrow 270. As a result, the various elements for conveying copying paper sheets (the conveying belt mechanism 94, the pair of switch-over roller pairs 102 and 104, the fixing device 96, etc.) are rotated so as to convey a copying paper sheet in the required manner.

In relation to the sprocket 308, a sprocket 328 is disposed on the rear surface of the unit frame 236 of the stock portion. The sprockets 308 and 328 are drivingly connected via a detachable clutch means (not shown) adapted to effect engagement and disengagement by moving the unit frame 236 in the front-back direction. A power transmission member 330 wrapped over the sprocket 328 is wrapped further over sprockets 332 and 334 and sprockets 336 and 338 and returns to the sprocket 328. (These elements are provided on the rear surface of the unit frame 236.) The sprocket 328 is drivingly connected to the conveying roller 130 via a clutch means (not shown) The sprocket 334 is drivingly connected to the conveying roller 120. The sprocket 336 is drivingly connected to the conveying roller 126. The sprocket 338 is drivingly connected to the feed roller 128 via a clutch means (not shown) (The clutch means interposed between the sprockets 328 and the conveying roller 130 becomes operative when part of the optical system 153 reaches a predetermined position during its scanning movement; consequently, the conveying rollers 130 and 132 start to convey a copying paper sheet having a copied image on one side in synchronism with the rotation of the rotation drum 8.) Hence, when the third power transmission member 244 is moved in the direction of arrow 326, the power transmission member 330 is moved in the direction shown by an arrow 340 via the sprockets 308 and 328. As a result, the various rollers for conveying copying paper sheets are rotated so as to convey a paper sheet in the required manner. The optical system 153 is driven by a driving source (not shown) for exclusive use provided in the upper supporting frame 162.

While the present invention has been described hereinabove with reference to one specific embodiment of the electrostatic copying apparatus constructed in accordance with this invention, it should be understood that the invention is not limited to such a specific embodiment, and various changes and modifications are possible without departing from the scope of the invention described and claimed herein.

For example, in the specific embodiment illustrated, the invention is applied to a copying apparatus capable of forming a copied image on both side of a copying paper sheet. However, the invention is not limited to this embodiment, and can also be applied to an ordinary copying apparatus capable of forming a copied image on one surface of a copying paper sheet.

What is claimed is:

1. A shell-type electrostatic copying apparatus comprising a supporting structure including a lower supporting frame and an upper supporting frame mounted on the lower supporting frame for free pivoting between an open position and a closed position about a first pivot axis as a center, an endless carrier member having a photosensitive material disposed on at least part of its peripheral surface, a developing device for developing a latent electrostatic image formed on the surface of the photosensitive material on the endless carrier member, and a copying paper conveying mechanism for conducting a copying paper sheet from one end of the supporting structure to the other; wherein the first pivot axis exists at said other end of the supporting structure, a supporting unit frame is mounted on the lower supporting frame so that it pivots freely about a second pivot axis extending substantially parallel to the first pivot axis, and the endless carrier member and the developing device are disposed on the supporting unit frame, a connecting means is provided for connecting the supporting unit frame to the upper supporting frame and being operable, in response to movement of the upper supporting frame about the first pivot axis, to pivot the supporting unit frame about the second pivot axis following the pivoting movement of the upper supporting frame;

said connecting means being releasable and including an engaging means disposed in either one of the upper supporting frame and the supporting unit frame and an engage means disposed in the other and adapted to come into and out of engagement with the engaging means, and the engaging means and the engage means are free to move relative to each other over a predetermined range while these means are in engagement with each other;

said engaging means being comprised of a moving member mounted on the upper supporting frame so that it can move freely between an engaging position and a nonengaging position; the engage means is comprised of a shaft member mounted on the supporting unit frame; and the moving member has formed therein an opening for detachably receiving the shaft member.

2. The electrostatic copying apparatus of claim 1 wherein the first pivot axis and the second pivot axis extend in the front-back direction, and the copying paper conveying mechanism extends substantially perpendicular to the front-back direction from said one end to said other end of the supporting structure.

3. The electrostatic copying apparatus of claim 1 wherein the second pivot axis exists at one end of the supporting unit frame which is said one end of the supporting structure; the other end of the supporting unit frame which is the other end of the supporting structure is adapted to be releasably connected to the upper supporting frame by the connecting means; when the upper supporting frame is pivoted in a predetermined direction about the first pivot axis toward the open position while the supporting unit frame is releasably connected to the upper supporting frame, the supporting unit frame is pivoted in a direction opposite to said predetermined direction about the second pivot axis as a center following the pivoting movement of the upper supporting frame.

4. The electrostatic copying apparatus of claim 3 wherein the developing device is disposed on said one end of the supporting unit frame, and the endless carrier member is disposed on the other end of the supporting unit frame with respect to the developing device.

5. The electrostatic copying apparatus of claim 1 wherein the supporting unit frame is detachably mounted on the lower supporting frame.

6. A shell-type electrostatic copying apparatus comprising, a supporting structure including a lower supporting frame and an upper supporting frame mounted on the lower supporting frame for pivotal movement between an open position and a closed position about a first pivot axis, a supporting unit frame mounted on the lower supporting frame for pivotal movement about a second pivot axis which is spaced from and substantially parallel to the first pivot axis, an endless carrier member having a peripheral surface which has a photosensitive material disposed on at least a portion thereof, a developing device for developing a latent electrostatic image formed on the surface of the photosensitive material on the endless carrier member, said endless carrier member and said developing device being disposed on the supporting unit frame, a copying paper conveying mechanism for conducting a copying paper sheet from one end of the supporting structure to the other end of the supporting structure, and a connecting means for connecting the supporting unit frame to the upper supporting frame at a location which lies between the first pivot axis and the second pivot axis; said connecting means being operable, when the upper supporting frame is pivoted in one direction about the first pivot axis toward the open position, to pivot the supporting unit frame about the second pivot axis in a direction opposite to said one direction.

7. The electrostatic copying apparatus of claim 6 wherein the first pivot axis is located at said other end of the supporting structure, and the second pivot axis is located at said one end of the supporting structure.

8. The electrostatic copying apparatus of claim 6 wherein the supporting unit frame is detachably mounted on the lower supporting frame.

9. The electrostatic copying apparatus of claim 6 wherein the connecting means connects the supporting unit frame releasably to the upper supporting frame.

10. The electrostatic copying apparatus of claim 9 wherein the connecting means includes an engaging means disposed in either one of the upper supporting frame and the supporting unit frame and an engage means disposed in the other and adapted to come into and out of engagement with the engaging means, and the engaging means and the engage means are free to move relative to each other over a predetermined range while these means are in engagement with each other.

* * * * *